US005637062A

United States Patent [19]

Schmittner

[11] Patent Number: 5,637,062

[45] Date of Patent: Jun. 10, 1997

[54] MULTIPURPOSE EXERCISE MACHINE

[76] Inventor: Norbert Schmittner, Fichtelbachstrasse 3, 86153 Augsburg, Germany

[21] Appl. No.: 348,889

[22] Filed: Nov. 25, 1994

[30] Foreign Application Priority Data

Nov. 26, 1993 [DE] Germany ..... 9318163 U

[51] Int. Cl.[6] ..... A63B 21/062; A63B 21/055

[52] U.S. Cl. ..... 482/97; 482/130

[58] Field of Search ..... 482/121, 122, 482/123, 130, 129, 97, 139, 136, 137, 135, 133

[56] References Cited

U.S. PATENT DOCUMENTS

| | | | |
|---|---|---|---|
| 3,701,529 | 10/1972 | Kruthaupt | 482/123 |
| 4,231,568 | 11/1980 | Riley et al. | 482/130 |
| 4,563,003 | 1/1986 | Bugallo et al. . | |
| 4,930,768 | 6/1990 | Lapcevic . | |
| 4,982,956 | 1/1991 | Lapcevic . | |
| 5,039,092 | 8/1991 | Olschansky et al. | 482/130 |

FOREIGN PATENT DOCUMENTS

| | | |
|---|---|---|
| 35 39 796 | 11/1985 | Germany . |
| 9001951 U | 9/1990 | Germany . |
| 9314794 U | 3/1994 | Germany . |

*Primary Examiner*—Stephen R. Crow
*Attorney, Agent, or Firm*—Oliff & Berridge

[57] ABSTRACT

A multipurpose exercise machine for fitness and strength training at home is convertible for various exercises. The exercise machine is compact, light in weight, and includes a frame, a shaft, an eccentric wheel, a displaceable traveler, a pulling element, at least one exercise lever, and an optional coupling element for adding additional parts.

18 Claims, 4 Drawing Sheets

MULTIPURPOSE EXERCISE MACHINE

BACKGROUND OF THE INVENTION

The invention relates to a multipurpose exercise machine for fitness and strength training, designed as a home exercise machine for training at home.

Exercise machines for muscle training are well known in the art. They consist of a frame with devices to support the body or individual parts of the body as well as a movable mechanism operable by muscular force, said mechanism being loaded by spring force or a counterweight, or containing a brake that creates resistance.

Exercise machines designed for professional use, in other words for fitness and strength training gymnasiums, are usually designed for only one very specific function, or at most for a small number of functions designed to exercise very specific muscle groups, since such gymnasiums have a number of machines that are used in succession by the persons undergoing training. These machines are rather large and take up a corresponding amount of space.

The exercise machines known to be available for home training include bicycle and rowing machines, training frames, and movable mechanisms for gymnastics or for lifting weights, as well as more demanding large devices with two or three functions, which are, however, mainly designed along the lanes of gymnasium equipment and are correspondingly large, cumbersome, and expensive.

SUMMARY OF THE INVENTION

The goal of the invention is to provide a multipurpose exercise machine for use in home training, characterized firstly by a wide variety of possible uses, in other words, useful for exercising as many muscle groups of the body as possible, and secondly by a very small space requirement.

As will be more apparent from the description of the example which follows, the exercise machine according to the invention is designed so that it requires minimum installation space, whereby it can be positioned a short distance from a wall and can be fastened to the wall, but fastening to the floor and hence drilling holes in the floor covering is unnecessary. The machine can be converted for various exercises by means of simple assembly techniques not requiring tools, and the resistance can likewise be changed in many ways by making a few manual adjustments without tools. The machine is simply but logically designed and, hence, very compact; it is light in weight and economical, but permits practically all of the muscle groups of the body to be exercised.

One embodiment of the exercise machine according to the invention will be described in greater detail below with reference to the attached drawings.

DETAILED DESCRIPTION OF PREFERRED EMBODIMENTS

Figure 1:
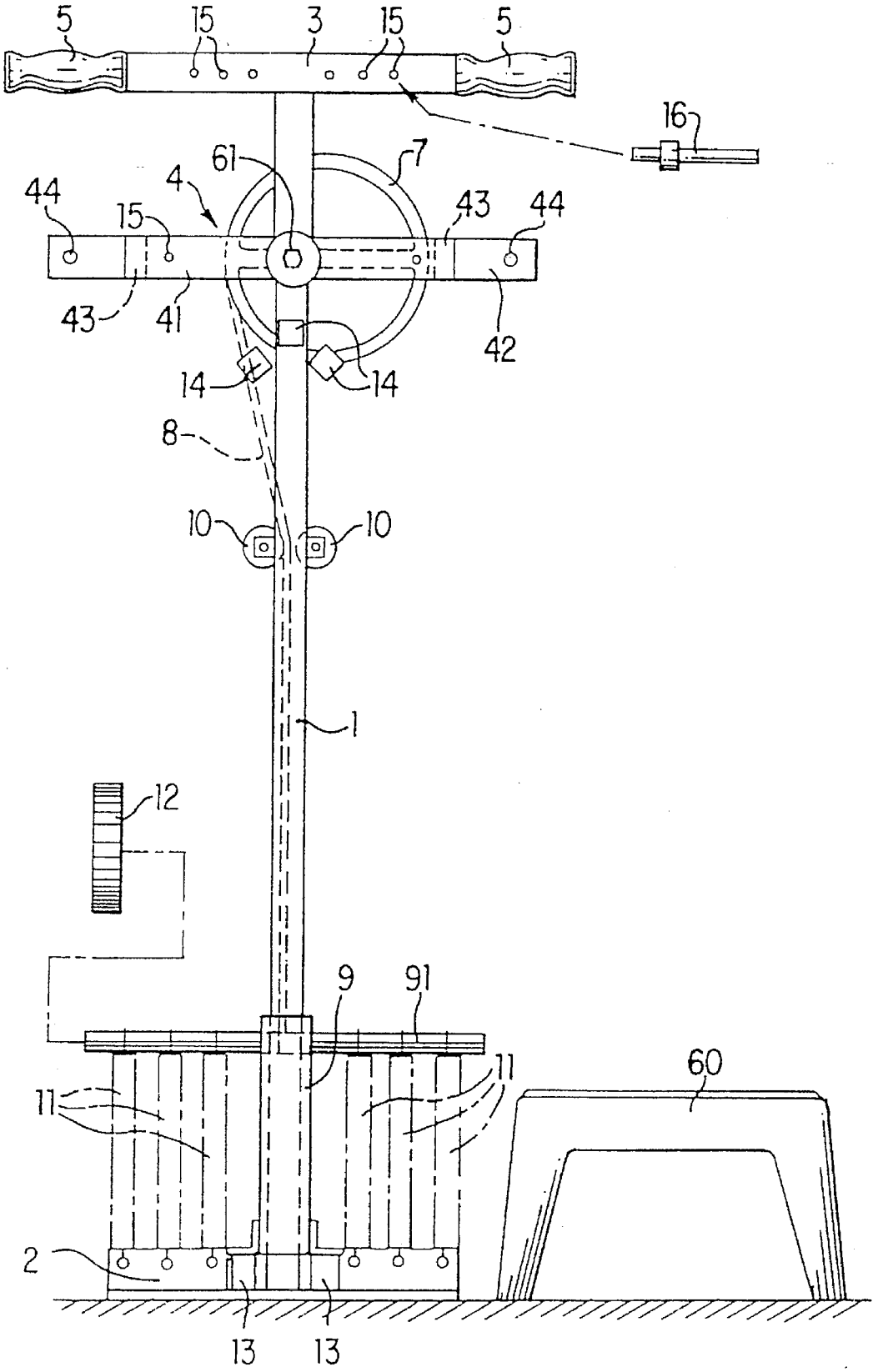
FIG. 1 shows a front view of an exercise machine embodying the invention.
Figure 3:
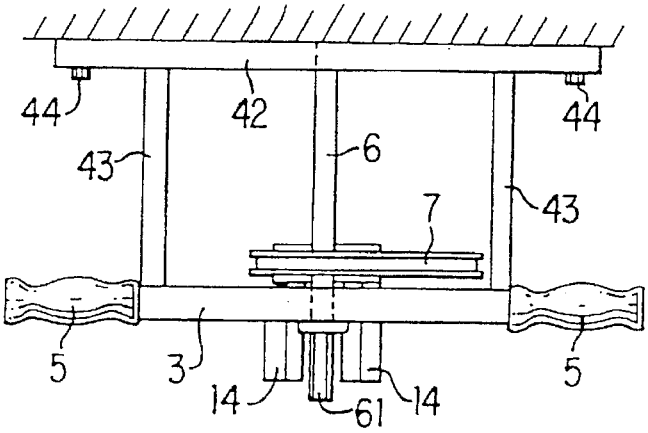
FIG. 3 shows a top view of the exercise machine.
Figure 2:
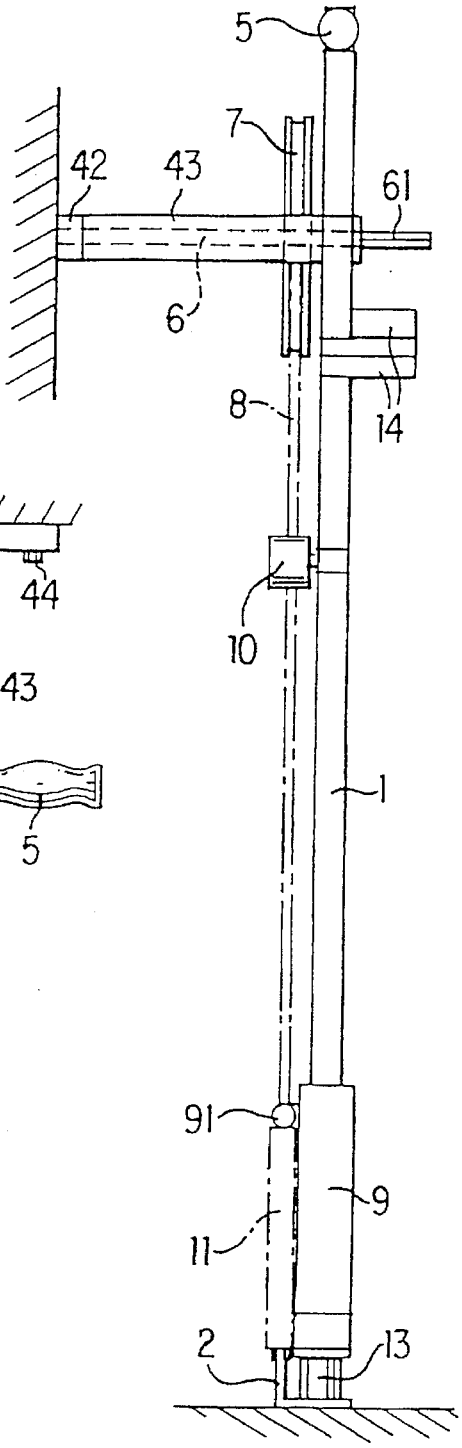
FIG. 2 shows a side view of the exercise machine.

FIGS. 1 through 3 show the essential design of the multipurpose exercise machine according to the invention.

The drawings are not necessarily to scale; wherever it is necessary to make the representation clearer, parts are shown slightly enlarged. In the top view in FIG. 3, everything that is part of the foot area of the machine has been omitted for the sake of clarity.

As shown in FIG. 1, the frame of the device consists of a support in the form of a column 1 with a foot 2, an upper cross member 3, and a horizontal frame 4 located below cross member 3.

In the embodiment shown in FIG. 1, column 1, designed as a simple rod, is advantageous in every respect, but the support could also be designed differently, for example as a standing flat frame. Similarly, instead of the upper cross member and the horizontal frame shown in the a standing flat frame. Similarly, instead of the upper cross member and the horizontal frame shown in the embodiment, a differently shaped framework could be used that would perform the same functions.

Here, foot 2 is designed as an angular section running transversely to column 1, but it can also be designed as a footplate or a spacer extending toward the wall and could have wall mounting brackets for additional fastening to the wall.

Upper cross member 3 is provided with handles 5 at each end that can be made removable and possibly adjustable on cross member 3 with regard to their lateral spacing from column 1. These handles 5 allow the user of the machine to grip them or to support him/herself with one or both hands on the frame of the exercise machine during certain exercises.

As seen in FIG. 3, horizontal frame 4 has a basically rectangular shape and consists of a front member 41 running parallel to cross member 3 and intersecting column 1, a rear member 42 parallel thereto and therefore behind column 1 at a distance, and two connecting members 43 between members 41 and 42.

Figure 4E:
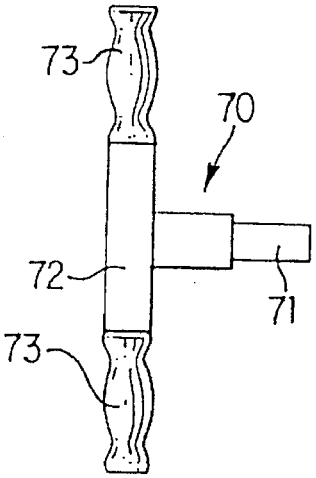
FIGS. 4*a*–4*e* show side views of optional pieces of equipment used with the exercise machine.
Figure 4A:
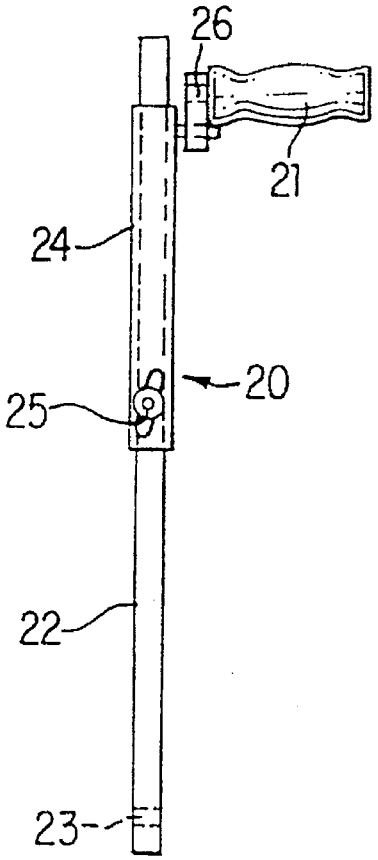
Figure 4B:
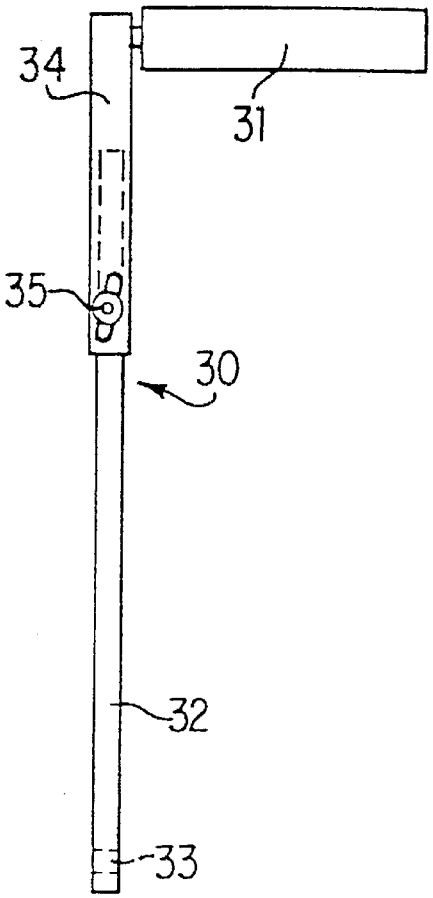
Figure 5:
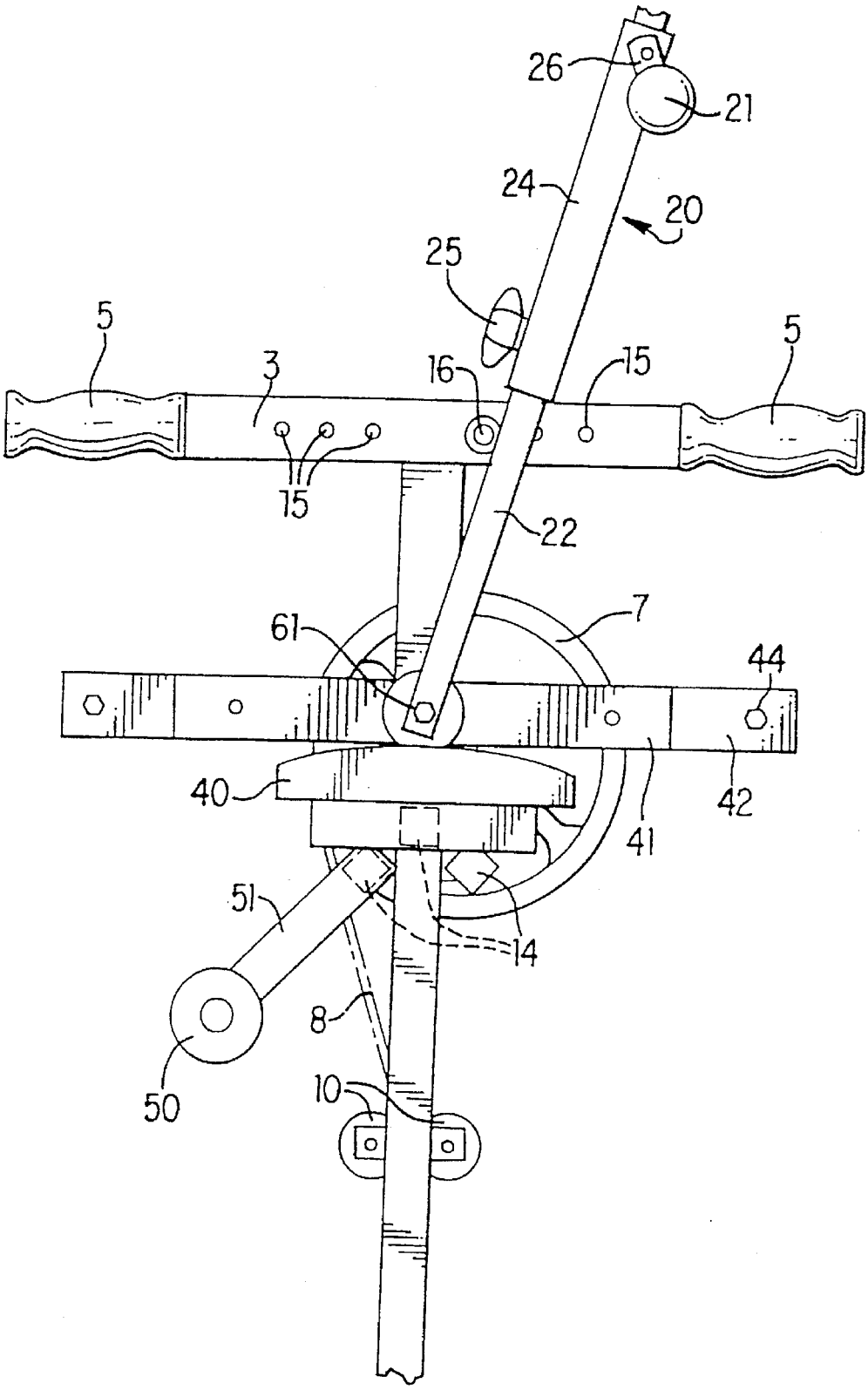
FIG. 5 is a partial front view of the exercise machine with a mounted training lever and cushions.

Rear frame member 42 is longer than front member 41 and has end parts projecting on both sides beyond connecting member 43, each of said end parts being provided with a hole for a screw 44 for fastening to the wall. Frame 4 thus serves primarily as a wall-fastening element for the machine and determines the distance of column 1 from the wall. However, the main function of the frame 4 is to receive and mount a horizontal shaft 6 running centrally between rear member 42 and front member 41, i.e. through the area of the intersection between front frame member 41 and column 1, said shaft being rotatably mounted in 4 and bearing an eccentric wheel 7 nonrotatably connected therewith, and guided forward through the area of the intersection between front member 41 and column 1, and terminating in a coupling shaft 61 projecting forward beyond column 1, said shaft 61 serving for nonrotatable mounting of optional exercise levers 20 or 30 as seen in FIGS. 4A and 4B and described in greater detail below. One mounted exercise lever is shown in FIG. 5, but has been omitted in FIG. 1 for the sake of clarity.

In the embodiment shown in FIG. 1, coupling shaft 61 is designed as a polygonal rod, while the exercise lever to be mounted has a matching polygonal hole, but it is understood that the coupling shaft can alternatively be designed as a sleeve with a polygonal hole into which a matching polygonal pin mounted on the exercise lever can be inserted. In the embodiment shown, the coupling shaft is a hexagonal rod, so that an exercise lever to be mounted can be inserted optionally in one of several positions, each 60° apart, but a wear-resistant nonrotatable connection between the coupling shaft and the exercise lever is ensured as well. Essentially, a square or octagonal rod could be used as well, but the square rod has the disadvantage of a smaller number of possible angular positions for the exercise lever to be mounted, while an octagonal or higher polygonal rod has the disadvantage of a less firm nonrotational connection between the coupling shaft and the exercise lever.

Eccentric wheel 7 sits on shaft 6 in such manner that the diameter of the eccentric wheel intersecting shaft 6 is roughly horizontal in the resting state and parallel frame 4. Preferably, it is made as a solid disk to reduce the risk of accident.

Eccentric wheel 7 is connected by a pulling element, namely a chain 8, with a traveler 9 guided on column 1, with chain 8 being guided between two guide rollers 10 located in the upper area of column 1 below frame 4, so that chain 8 always runs parallel, i.e. vertically, along the back of column 1 below guide rollers 10.

Traveler 9 guided on column 1 has a crossbar 91, which, like the angle section forming foot 2, extends symmetrically on both sides of column 1. Between crossbar 91 and foot 2, coil springs 11 are arranged symmetrically and pairwise with respect to column 1, one end of each spring being attached to crossbar 91 and the other end of each spring being attached to the vertical angle section leg of foot 2. In the embodiment, six springs, i.e. three pairs of springs, are shown, but more or fewer spring pairs could be provided. The pairwise arrangement of the springs, as is readily apparent, ensures symmetrical and tilt-free loading of traveler 9.

Depending on the requirements, one or more pairs of springs can be added for training to vary the resistance to be overcome.

Crossbar 91 is preferably made as a round rod and can be of the same length as or longer than foot 2, and instead of springs 11, disk weights 12 can optionally be insertable symmetrically on the ends of crossbar 91 on both sides. Of course, especially when crossbar 91 is longer than foot 2, spring pairs and disk weights can be combined as desired.

By rotating eccentric wheel 7 by means of an exercise lever placed on coupling shaft 61, as will be described in greater detail below, traveler 9 is lifted upward by chain 8, stretching springs 11 or acting against the weight of disk weights 12 mounted on crossbar 91. Rubber bumpers 13 are advantageously provided between the lower end of traveler 9 and foot 2 to dampen any impacts of traveler 9. Of course, other suitable measures can be provided instead of or as well as rubber bumpers 13 to dampen the return of traveler 9.

The significance of eccentric wheel 7 lies in the fact that when an exercise lever placed on coupling shaft 61 is rotated, the wheel creates a pattern of travel of traveler 9 that is nonlinear with respect to the rotational angle, and thus creates a nonlinear force pattern that is adapted to anatomical conditions during the contraction of a muscle to be trained.

A number of square pins 14 are located below the intersection of front frame member 41 with column 1, said pins serving for optional mounting of equipment described in greater detail below. In the embodiment shown, three such square pins 14 are provided, located 45° apart as shown.

FIGS. 4*a* and 4*b* show two different exercise levers 20 and 30, optionally mountable on coupling shaft 61, with exercise lever 20 having a handle 21 for gripping with the hand to exercise the arm, while exercise lever 30 has a larger roller body 31 projecting at right angles therefrom provided for application of the legs or neck.

Both exercise levers 20 and 30 are made extendable by telescoping and consist of a rod 22 or 32 with a hexagonal opening 23 or 33 for mounting on coupling shaft 61, as well as a sleeve 24 or 34 mountable on said rod, on which handle 21 or roller body 31 is located and which is provided with a locking element 25 or 35 for securing it in the selected position on the rod as shown, whereby the locking element can be in the form of a clamping screw for continuous adjustment of the sleeve on the rod or possibly in the form of a pin for stepwise length adjustment of the exercise lever in cooperation with a row of matching holes in the rod.

In the case of exercise lever 20 shown in FIG. 4*a*, it is important for handle 21 to be rotatably connected by a short crank arm 26 with sleeve 22 to permit automatic length adjustment during the rotary movement of the lever in case the natural path of movement of the hand grasping the handle during a training exercise does not correspond exactly with the curved path of the exercise lever or crank pivot.

Figure 4C:
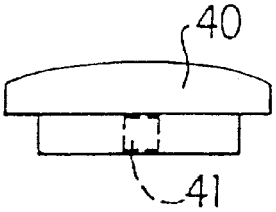
Figure 4D:
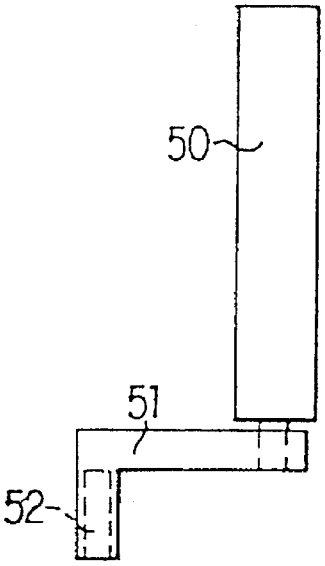

FIGS. 4*c* and 4*d* show mountable devices for optional mounting on square pins 14, namely an armrest cushion 40 in FIG. 4*c* with a square hole 41 and, in FIG. 4*d*, a support 50.

Support 50 is roll-shaped so that it can be used on all sides for leaning the thighs, buttocks, back, or abdomen of the body against it during certain exercises. Support 50 further has a bar 51 bent at right angles with a square hole 52 so that, depending on which of lateral square pins 14 on the frame it is mounted on, it is located on one side or the other of the center of the frame. The relationships, namely the provision of square pins 14 on the frame, the design of armrest cushions 48, and the bend of bar 51 of support 50, are chosen for the comfort and support of the user. For example, when pushing downward, the user supports his/her elbow on the armrest cushion in order to press the exercise lever sideways with the arm, the pivot point of the arm roughly corresponding to the rotational axis of shaft 6. Similarly, when the user, for example, presses his/her abdomen against support 50 in order to move the exercise lever with the neck, the pivot point of the body once again roughly corresponds with rotational axis 6 while the upper body is bent.

One particular advantage of the exercise machine lies in the fact that working strokes of the exercise levers can be made with rotation to the right as well as to the left, so that the device can be used for training both arms, both legs, pressing the arms to one side or the other, etc., without any retrofitting of the device itself being required apart from mounting the exercise lever on coupling shaft 61 in an orientation that points to the left or right. The only action to be taken in making a transition from a working stroke that rotates rightward (corresponding to the drawing in FIG. 1, with the upper end of the chain guided toward the left side of eccentric wheel 7) is to adjust eccentric wheel 7 by rotating it through 180°, i.e. by rotating the major part of the eccentric wheel, which points to the right in the drawing in FIG. 1, leftward counterclockwise, so that the part of the eccentric wheel that receives the end of the chain, at the left in FIG. 1, is pivoted down and around toward the right-hand side and the chain then engages the eccentric wheel on the right. Because of the eccentric mounting of the eccentric wheel, the weight-produced torque of the larger half of the eccentric wheel always ensures stability in one position or the other.

In FIG. 1, holes 15 for optional mounting of a stop pin 16 are provided in cross member 3 and front member 41 of frame 4. In this manner, the exercise machine can be brought into a pretensioned position, by mounting an exercise lever on coupling shaft 61, rotating eccentric wheel 7 through a certain range, thereby lifting traveler 9 a corresponding distance and tensioning springs 11, and inserting stop pin 16 into matching hole 15, holding the exercise lever in the pretensioned position and preventing it from moving backward. Training can then begin from the pretensioned position.

The exercise machine is preferably provided with a stool 60, with the height of the stool being adjusted so that the user stands in front of the machine for certain exercises, for example arm presses, but stands on the stool for leg exercises, for example. This allows leg exercises that involve swinging the legs to be performed without the feet striking the floor.

Measures can also be provided to permit handles 5 to be mounted in other positions on the cross member or on frame 4, or an additional handle device, for example with handles oriented vertically, can be provided on one side or the other of cross member 3 or of frame 4, to provide support in certain exercises, for example in arm presses, as an alternative to using the support, with the free hand holding on to such a handle. Such a mountable handle device 70 is shown in FIG. 4*e* and has a horizontal shaft 71, a vertical member 72, and two handles 73 located at the two ends of the member that can be used optionally. Shaft 71 can be inserted laterally instead of handle 5, optionally from left or right, into the upper frame member, or into the left or right lateral end of front member 41 of frame 4.

FIG. 5 shows in an enlarged representation the upper part of the device in a state prepared for arm presses. For this purpose, exercise lever 20 (FIG. 4*a*) has been mounted on coupling shaft 61 in such a manner that it projects slightly diagonally upward to the right. In one of holes 15 in upper cross member 3, a stop pin 16 has been inserted against which the left edge of exercise lever 20 rests. As is evident from the position of eccentric wheel 7 with respect to FIG. 1, the device is pretensioned, in other words the eccentric wheel has already been rotated partially so that the exercise lever is already under tension in the position shown and is prevented by stop pin 16 from returning to the relaxed position. Armrest cushion 40 shown in FIG. 4*c* is mounted on central square pin 14 of the frame, on which cushion the elbow is supported during arm presses. In addition, support 50 is mounted on left square pin 14 in FIG. 1, said pin being rotated through 45° with respect to the middle square pin, so that bar 51 of the armrest cushion extends diagonally downward to the left and support 50 is located below armrest cushion 40 to the left of column 1. Exercise lever 20 can be tensioned clockwise, so that the device is now prepared for arm presses by the left arm of the user standing before the device, who rests his/her left hip against support 50, supports his/her elbow on armrest cushion 40, and grips handle 51 of exercise lever 20 with the left fist in order to press on it and rotate it to the right.

The exercise machine according to the invention described above offers the opportunity to train the muscles of the inner and outer leg, the gluteal and abdominal muscles, the lumbar and back muscles, the muscles of the front and back of the upper leg, the muscles of the upper arm at front and back, as well as the muscles of the shoulders and chest.

Column 1 of the machine can be adjusted heightwise, with a telescoping column section advantageously being provided above the area of traveler 9 travel, in which locking means, e.g. holes and pins to secure said section at the desired height, are provided. This is not shown in the drawings, but is readily accomplished by an individual skilled in the art. The machine can thus be adjusted to different body sizes.

Foot 2, as mentioned above, does not have to be fastened to the floor. Advantageously, however, a skid-proof coating is provided on the underside of the foot.

I claim:

1. A multipurpose exercise machine for muscle and strength training, comprising:

a) a frame with a vertical support having a front and a rear, a foot, and an upper framework mounted on the vertical support and extending rearward therefrom;

b) a shaft rotatably mounted on the upper framework and extending horizontally from and perpendicular thereto, said shaft being located essentially centrally with respect to the vertical support, and said shaft having at a forward end a mounting shaft;

c) an eccentric wheel nonrotatably mounted on said shaft, an essentially horizontal diameter of said wheel intersecting the shaft in a resting position of the machine;

d) a displaceable traveler guided along said vertical support and loaded by a means for providing resistance comprising one of a pair of springs and a pair of weights;

e) a pulling element connecting the displaceable traveler with a circumference of the eccentric wheel, the pulling element being connected to the circumference of the eccentric wheel at essentially the horizontal diameter;

f) at least one exercise lever optionally nonrotatably, insertably connected with the mounting shaft such that the resistance means provides resistance against movement of the exercise lever, thereby providing a means of exercising various muscle groups; and g) at least one insertable coupling element located on the front of the vertical support near the shaft for mounting of a part having a matching receptacle.

2. The multipurpose exercise machine according to claim 1 further comprising a handle on the upper framework.

3. The multipurpose exercise machine according to claim 1 wherein the vertical support is a rod-shaped column and the upper framework is a horizontal frame comprising a front cross member connected to the vertical support, a rear cross member parallel to the front cross member at a distance therefrom, and at least one connecting member extending therebetween, the shaft extending from the front cross member to the rear cross member.

4. The multipurpose exercise machine according to claim 1 wherein the upper framework further comprises an upper cross member located above the horizontal frame on the vertical support, the upper cross member having a handle on either end.

5. The multipurpose exercise machine according to claim 1 wherein the upper framework further comprises receiving holes for optional insertion of a stop pin that projects forward into a pivot path of the exercise lever.

6. The multipurpose exercise machine according to claim 3 wherein the traveler comprises a tubular body surrounding the rod-shaped column displaceable thereon by sliding, and a lower cross member fastened thereto and extending symmetrically from both sides of the rod-shaped column, said lower cross member serving to support one of the pair of weights and upper ends of the pair of springs, a lower end of the pair of springs being attached to the foot.

7. The multipurpose exercise machine according to claim 3 further comprising a pair of guide rollers mounted on the rod-shaped column below the eccentric wheel for guiding the pulling element.

8. The multipurpose exercise machine according to claim 1 wherein the pulling element is a chain.

9. The multipurpose exercise machine according to claim 1 wherein the mounting shaft is a hexagonal rod and the exercise lever has a corresponding hexagonal hole.

10. The multipurpose exercise machine according to claim 1 wherein the exercise lever further comprises a rod having a matching element for mounting on the mounting shaft, and a displaceable sleeve guided lengthwise on the rod with a locking element for locking the displaceable sleeve in a selected position along the mounting shaft, the displaceable sleeve further comprising a gripping element.

11. The multipurpose exercise machine according to claim 10 wherein the gripping element is connected by a short crank arm with the displaceable sleeve.

12. The multipurpose exercise machine according to claim 1 wherein the foot includes a traverse angle section having a lower horizontal L-leg and a rear vertical L-leg disposed essentially in a plane of the eccentric wheel and further having at least one hole for connecting the lower ends of the pair of springs to the traveler.

13. The multipurpose exercise machine according to claim 1 further comprising a damping element between the foot and the traveler.

14. The multipurpose exercise machine according to claim 1 wherein the optionally insertable coupling element is in the form of a square pin.

15. The multipurpose exercise machine according to claim 1 further comprising an armrest cushion mountable on the optionally insertable coupling element, a surface of the armrest cushion being substantially level with a horizontal axis of the shaft when mounted.

16. The multipurpose exercise machine according to claim 1 further comprising a support with a bar at right angles, said support being mountable on the optionally insertable coupling element.

17. The multipurpose exercise machine according to claim 2 wherein the handle mounted on the upper framework comprises at least one vertically oriented handle.

18. The multipurpose exercise machine according to claim 1 wherein the vertical support is height-adjustable.

* * * * *